US011346208B2

(12) United States Patent
Fan et al.

(10) Patent No.: US 11,346,208 B2
(45) Date of Patent: May 31, 2022

(54) CORRECTION METHOD FOR END-OF-PIPE EFFECT ON MAGNETIC RANGING

(71) Applicant: Halliburton Energy Services, Inc., Houston, TX (US)

(72) Inventors: Yijing Fan, Singapore (SG); Burkay Donderici, Houston, TX (US); Hsu-Hsiang Wu, Sugarland, TX (US); Li Pan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/651,538

(22) PCT Filed: Dec. 21, 2017

(86) PCT No.: PCT/US2017/067990
§ 371 (c)(1),
(2) Date: Mar. 27, 2020

(87) PCT Pub. No.: WO2019/125475
PCT Pub. Date: Jun. 27, 2019

(65) Prior Publication Data

US 2020/0308957 A1 Oct. 1, 2020

(51) Int. Cl.
*E21B 47/0228* (2012.01)
*E21B 47/092* (2012.01)

(52) U.S. Cl.
CPC ..... *E21B 47/0228* (2020.05); *E21B 47/092* (2020.05)

(58) Field of Classification Search
None
See application file for complete search history.

(56) References Cited

U.S. PATENT DOCUMENTS 5,923,170 A * 7/1999 Kuckes ..... E21B 47/0228 324/326
8,418,782 B2 4/2013 Waters et al.
(Continued)

FOREIGN PATENT DOCUMENTS

WO 2015200751 12/2015
WO 2016025245 2/2016

OTHER PUBLICATIONS

ISRWO International Search Report and Written Opinion for PCT/US2017/067990 dated Sep. 6, 2018.

*Primary Examiner* — Douglas X Rodriguez
(74) *Attorney, Agent, or Firm* — Benjamin Ford; C. Tumey Law Group PLLC

(57) ABSTRACT

A method and system for electromagnetic ranging of a target wellbore. A method may comprise disposing an electromagnetic ranging tool in a wellbore, energizing a conductive member disposed in the target wellbore to create an electromagnetic field, measuring at least one component of the electromagnetic field from the target wellbore, performing at least two non-axial magnetic field measurements, performing at least one axial magnetic field measurement, calculating a processed non-axial magnetic field measurement using the at least two non-axial magnetic field measurements, calculating an end-of-pipe ratio with the processed non-axial magnetic field measurement and the at least one axial magnetic field measurement, and altering a course of the electromagnetic ranging tool based at least in part from the end-of-pipe ratio. A well ranging system may comprise a downhole assembly, a sensor comprising a first component and a second component, a drill string, and an information handling system.

21 Claims, 7 Drawing Sheets

(56) References Cited

U.S. PATENT DOCUMENTS

| | | | | |
|---|---|---|---|---|
| 2016/0258275 | A1 | 9/2016 | Wu et al. | |
| 2016/0258276 | A1 | 9/2016 | Donderici et al. | |
| 2016/0273337 | A1 | 9/2016 | Donderici et al. | |
| 2017/0074087 | A1* | 3/2017 | Donderici | G01V 3/26 |
| 2017/0191349 | A1 | 7/2017 | Wu et al. | |
| 2017/0254193 | A1 | 9/2017 | Wu et al. | |
| 2018/0038225 | A1 | 2/2018 | Wilson et al. | |
| 2018/0156028 | A1 | 6/2018 | Wu et al. | |

* cited by examiner

CORRECTION METHOD FOR END-OF-PIPE EFFECT ON MAGNETIC RANGING

BACKGROUND

Wellbores drilled into subterranean formations may enable recovery of desirable fluids (e.g., hydrocarbons) using a number of different techniques. Knowing the location of a target wellbore may be important while drilling a second wellbore. For example, in the case of a target wellbore that may be blown out, the target wellbore may need to be intersected precisely by the second (or relief) wellbore in order to stop the blow out. Another application may be where a second wellbore may need to be drilled parallel to the target wellbore, for example, in a steam-assisted gravity drainage ("SAGD") application, wherein the second wellbore may be an injection wellbore while the target wellbore may be a production wellbore. Yet another application may be where knowledge of the target wellbore's location may be needed to avoid collision during drilling of the second wellbore.

Electromagnetic ranging is one technique that may be employed in subterranean operations to determine direction and distance between two wellbores. Devices and methods of electromagnetic ranging may be used to determine the position and direction of a target well. For example, electromagnetic ranging methods may energize a target well by a current source on the surface and measure the electromagnetic field produced by the target well on a logging and/or drilling device in the second wellbore, which may be disposed on a bottom hole assembly. Methods in which energizing may occur from the target wellbore may experience an End-of-Pipe Effect, which may skew direction and distance measurements between two wellbores.

BRIEF DESCRIPTION OF THE DRAWINGS

These drawings illustrate certain aspects of some of the examples of the present invention, and should not be used to limit or define the invention.

DETAILED DESCRIPTION

Figure 1:
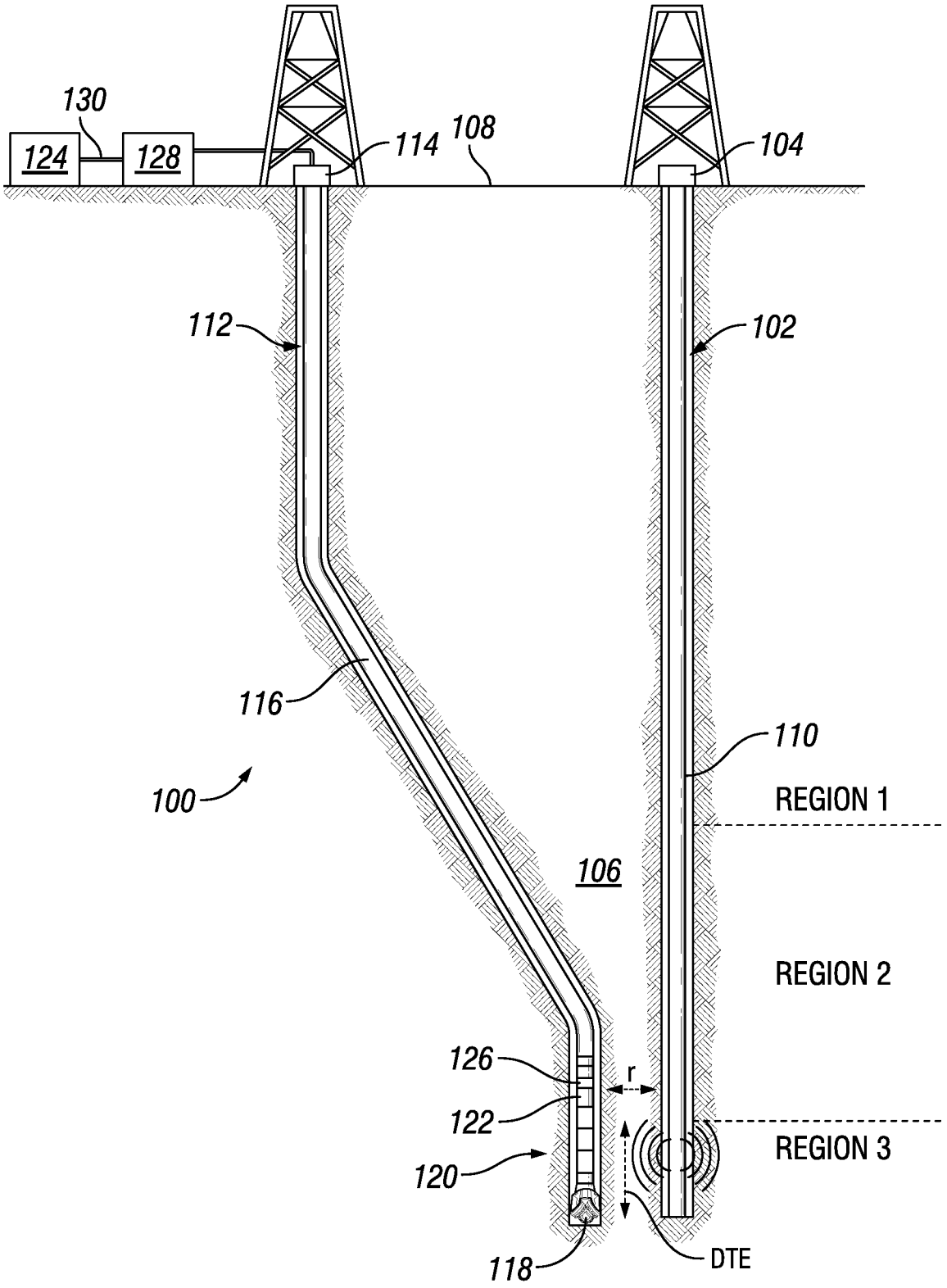
FIG. 1 is an example of an electromagnetic ranging system.

The present disclosure relates generally to a system and method for electromagnetic ranging. More particularly, a system and method for correcting distance and direction measurements from an end-of-pipe effect with an electromagnetic ranging tool. The end-of-pipe effect may be defined as a loss and/or dissipation of current at an end of a target well opposite the surface. The disclosure describes a system and method for electromagnetic ranging that may be used to determine the position and direction of a target well by sensors in an electromagnetic ranging tool. Electromagnetic ranging tools may comprise a tubular assembly of modular sections, which may comprise any number and/or type of sensors. The energizing of a target well and recording of signals by sensors on an electromagnetic ranging tool may be controlled by an information handling system.

Certain examples of the present disclosure may be implemented at least in part with an information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

FIG. 1 illustrates an electromagnetic sensor system 100. Specifically, FIG. 1 shows an electromagnetic sensor system 100 for ranging. As illustrated, a target wellbore 102 may extend from a first wellhead 104 into a subterranean formation 106 from a surface 108. Generally, target wellbore 102 may include horizontal, vertical, slanted, curved, and other types of wellbore geometries and orientations. Target wellbore 102 may be cased or uncased. A conductive member 110 may be disposed within target wellbore 102 and may comprise a metallic material that may be conductive and magnetic. By way of example, conductive member 110 may be a casing, liner, tubing, or other elongated steel tubular disposed in target wellbore 102. Determining the position and direction of target wellbore 102 accurately and efficiently may be required in a variety of applications. For example, target wellbore 4 may be a "blowout" well. Target wellbore 102 may need to be intersected precisely by a second wellbore 112 in order to stop the "blowout." Alternatively, it may be desired to avoid collision with target wellbore 102 in drilling second wellbore 112 or it may be desired to drill the second wellbore parallel to the target wellbore 102, for example, in SAGD applications. In examples, target wellbore 102 may be energized from surface 108. Electromagnetic sensor system 100 may be used for determining the location of target wellbore 102 with respect to second wellbore 112.

With continued reference to FIG. 1, second wellbore 112 may also extend from a second wellhead 114 that extends into subterranean formation 106 from surface 108. Generally, second wellbore 112 may include horizontal, vertical, slanted, curved, and other types of wellbore geometries and orientations. Additionally, while target wellbore 102 and second wellbore 112 are illustrated as being land-based, it should be understood that the present techniques may also be applicable in offshore applications. Second wellbore 112 may be cased or uncased. In examples, a drill string 116 may begin at second wellhead 114 and traverse second wellbore 112. A drill bit 118 may be attached to a distal end of drill string 116 and may be driven, for example, either by a downhole motor and/or via rotation of drill string 116 from surface 108. Drill bit 118 may be a part of electromagnetic ranging tool 120 at distal end of drill string 116, While not illustrated, electromagnetic ranging tool 120 may further comprise one or more of a mud motor, power module, steering module, telemetry subassembly, and/or other sensors and instrumentation as will be appreciated by those of ordinary skill in the art. As will be appreciated by those of ordinary skill in the art, electromagnetic ranging tool 120 may be a measurement-while drilling (MWD) or logging-while-drilling (LWD) system.

As illustrated, electromagnetic sensor system 100 may comprise a sensor 122. Sensor 122 may comprise gradient sensors, magnetometers, wire antenna, toroidal antenna, azimuthal button electrodes, and/or coils. In examples, there may be a plurality of sensors 122 disposed on electromagnetic ranging tool 120. While FIG. 1 illustrates use of sensor 122 on drill string 116, it should be understood that sensor 122 may be alternatively used on a wireline. Sensor 122 may be a part of electromagnetic ranging tool 120. Sensor 122 may be used for determining the distance and direction to target wellbore 102. Additionally, sensor 122 may be connected to and/or controlled by information handling system 124, which may be disposed on surface 108. In examples, information handling system 124 may communicate with sensor 122 through a communication line (not illustrated) disposed in (or on) drill string 116. In examples, wireless communication may be used to transmit information back and forth between information handling system 124 and sensor 122. Information handling system 124 may transmit information to sensor 122 and may receive as well as process information recorded by sensor 122. In addition, sensor 122 may include a downhole information handling system 126, which may also be disposed on electromagnetic ranging tool 120. Downhole information handling system 126 may include a microprocessor or other suitable circuitry, for estimating, receiving and processing signals received by the electromagnetic induction tool 122. Downhole information handling system 126 may further include additional components, such as memory, input/output devices, interfaces, and the like. While not illustrated, the sensor 122 may include one or more additional components, such as analog-to-digital converter, filter and amplifier, among others, that may be used to process the measurements of the sensor 122 before they may be transmitted to surface 108. Alternatively, raw measurements from sensor 122 may be transmitted to surface 108.

Any suitable technique may be used for transmitting signals from sensor 122 to surface 108, including, but not limited to, wired pipe telemetry, mud-pulse telemetry, acoustic telemetry, and electromagnetic telemetry. While not illustrated, electromagnetic ranging tool 120 may include a telemetry subassembly that may transmit telemetry data to the surface. An electromagnetic source in the telemetry subassembly may be operable to generate pressure pulses in the drilling fluid that propagate along the fluid stream to surface 108. At surface 108, pressure transducers (not shown) may convert the pressure signal into electrical signals for a digitizer 128. Digitizer 128 may supply a digital form of the telemetry signals to information handling system 124 via a communication link 130, which may be a wired or wireless link. The telemetry data may be analyzed and processed by information handling system 124. For example, the telemetry data could be processed to determine location of target wellbore 102. With the location of target wellbore 102, an operator may control the electromagnetic ranging tool 120 while drilling second wellbore 112 to intentionally intersect target wellbore 102, avoid target wellbore 102, and/or drill second wellbore 112 in a path parallel to target wellbore 102.

An inversion scheme, for example, may be used to determine location of target wellbore 102 (Referring to FIG. 1) based on electromagnetic field measurements from sensor 122. By way of example, the distance and direction of target wellbore 102 may be determined with respect to second wellbore 112. Determination of distance and direction may be achieved by utilizing the relationships below between target wellbore 102 and the magnetic field received by sensor 122.

$$H = \frac{I}{2\pi r} \tag{1}$$

wherein H is the magnetic field vector, I is the current on conductive member 110 in target wellbore 102, r is the shortest distance between sensor 122 and conductive member 110. It should be noted that this simple relationship assumes constant conductive member 110 current along target wellbore 102, however, persons of ordinary skill in the art will appreciate that the concept may be extended to any current distribution by using the appropriate model. It may be clearly seen that both distance and direction may be calculated by using this relationship. In the inversion scheme, a gradient field may be given by $$\frac{\partial H}{\partial r} = -\frac{I}{2\pi r^2} \tag{2}$$

where r may be computed as:

$$r = H \Big/ \frac{\partial H}{\partial r} \tag{3}$$

Figure 2:
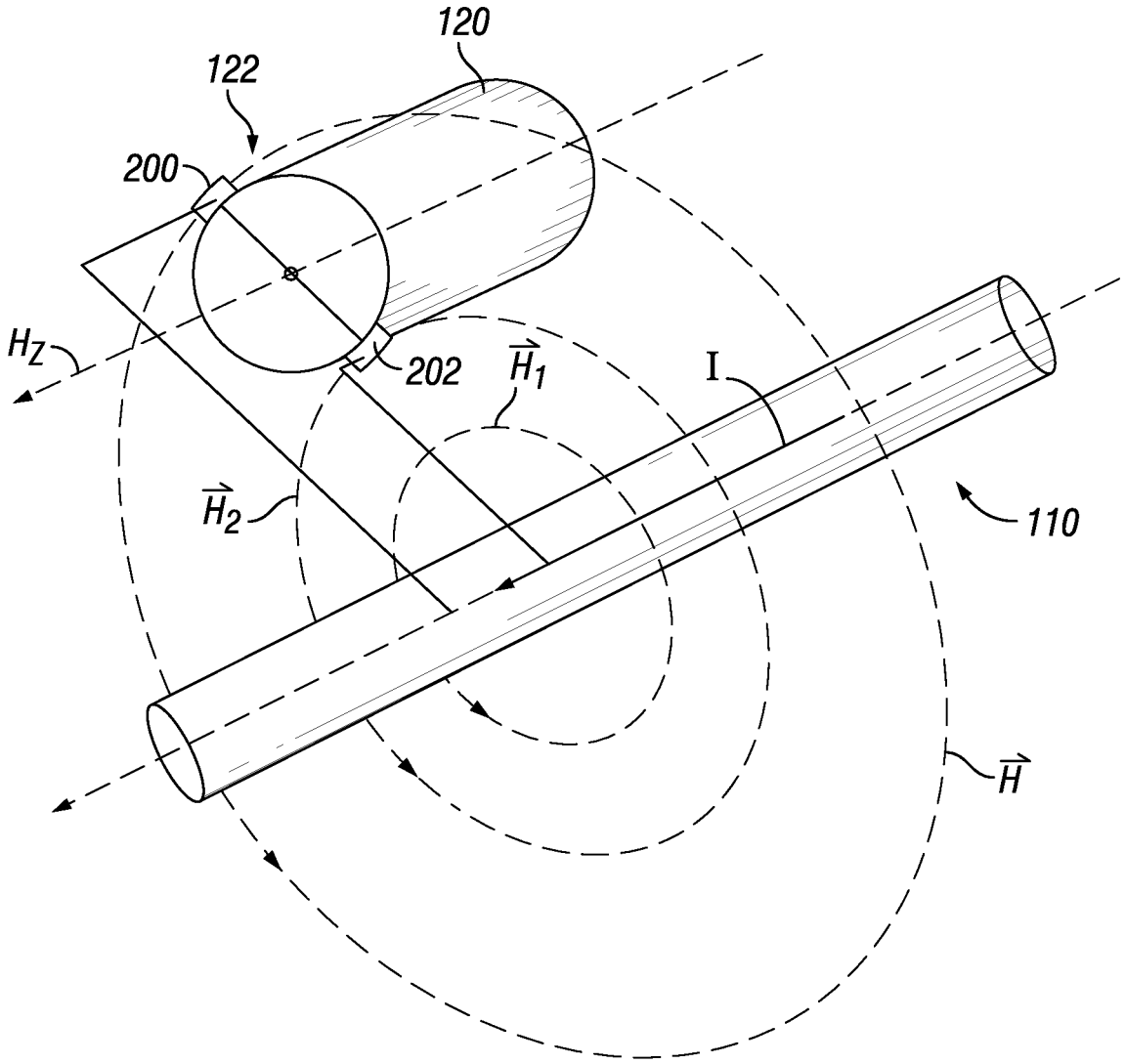
FIG. 2 is an example of a downhole assembly in proximity to a target wellbore.

Equation (3) may be a conventional gradient method to computer ranging distance. In examples, as illustrated in FIG. 2, sensor 122 may comprise a first component 200 and a second component 202.

In examples, magnetic field gradient measurements may be utilized, where spatial change in the magnetic field may be measured in a direction that may have a substantial component in the radial (r-axis) direction and $\phi$ is a vector that is perpendicular to both z axis of sensor 122 and the shortest vector that connects conductive member 110 to sensor 122, as seen below:

$$\overline{H} = \frac{I}{2\pi r}\hat{\phi} \tag{4}$$

$$\frac{\partial \overline{H}}{\partial r} = -\frac{I}{2\pi r^2}\hat{\phi} \tag{5}$$

wherein ∂ is the partial derivative. With this gradient measurement available in addition to an absolute measurement, it may be possible to calculate the distance as follows:

$$r = \frac{|\overline{H}|}{\left|\frac{\partial \overline{H}}{\partial r}\right|} \tag{6}$$

As such, Equation (6) may not require knowledge of the conductive member 110 current I, if both absolute and gradient measurements are available. Thus, the inversion scheme and/or gradient measurements may be used to transform information recorded by sensor 122 into distance and direction measurements.

Additionally, a finite difference method may be utilized to calculate the magnetic field strength and the gradient field strength as shown below:

$$\overline{H} = \frac{\overline{H}_1 + \overline{H}_2}{2} \tag{7}$$

$$\frac{\partial \overline{H}}{\partial r} = \frac{\overline{H}_1 - \overline{H}_2}{\Delta S} \tag{8}$$

Where $H_1$ and $H_2$ are the total field measurements at first component 200 and second component 202, respectively. Delta S may be defined as the separation between first component 200 and second component 202, thus Equation (3) may be modified based on the finite difference method to compute the ranging distance r as seen below:

$$r = \left|\frac{\frac{\overline{H}_1 + \overline{H}_2}{2}}{\frac{\overline{H}_1 - \overline{H}_2}{\Delta S}}\right| \tag{9}$$

An important assumption for the gradient method is that Ampere's law (Equation (1)), is only valid when the infinite long current source model is valid. However, when sensor 122 approach the end-of-pipe of target wellbore 102 (Referring to FIG. 1), one side of target well 102 (Distance to End (DTE) as shown in FIG. 1) may be comparable to ranging distance (r). Thus, infinite long source model is no longer valid and Ampere's law is no longer valid. There will be an end-of-pipe (EOP) effect when sensor 122 is near the end of target well 102. Due to this effect, the gradient method may not provide accurate ranging distance in the last a few tens of meters.

Figure 3:
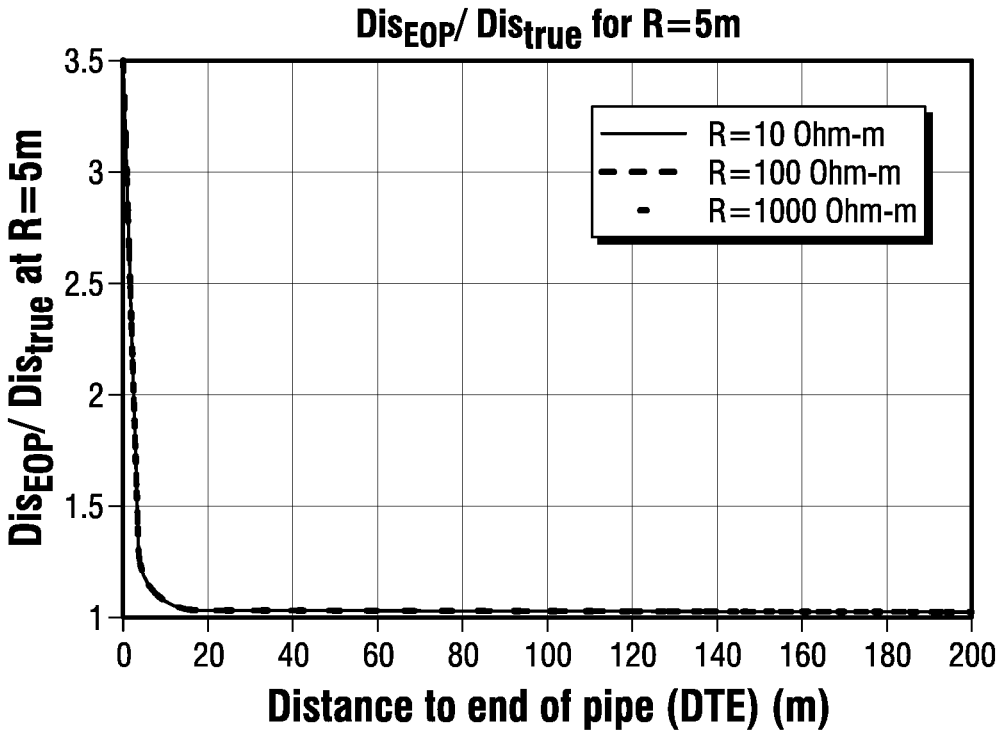
FIG. 3 is a graph of end-of-pipe ratio graph.
Figure 4:
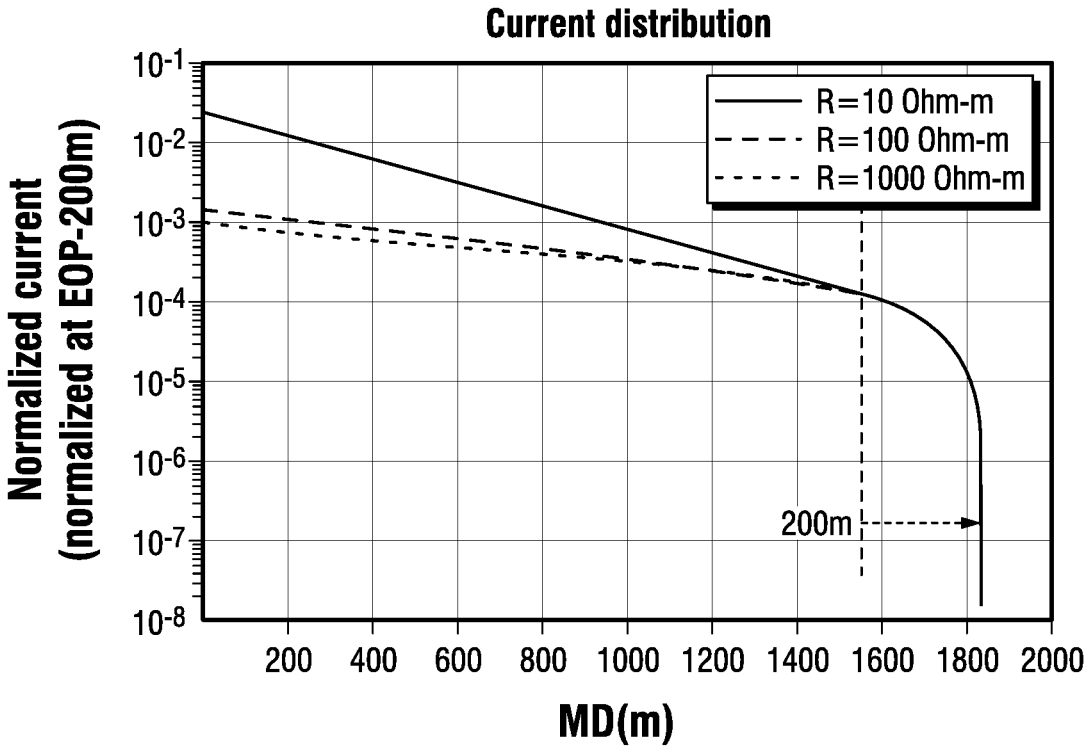
FIG. 4 is a graph of current distribution.

As illustrated in FIG. 3, the mapping curve between DTE and $$\frac{Dis_{EOP}}{Dis_{true}}$$

are almost the same despite the changes of simulation parameters ($Dis_{EOP}$ is calculated length to the end of the pipe and $Dis_{TRUE}$ is the actual length to the end of the pipe). This is because although the current dropping rate in linear region is different with different simulation parameters as shown in FIG. 4, the dropping rates are similar for the last 100 meters when they approach the end of target wellbore 102.

Figure 5:
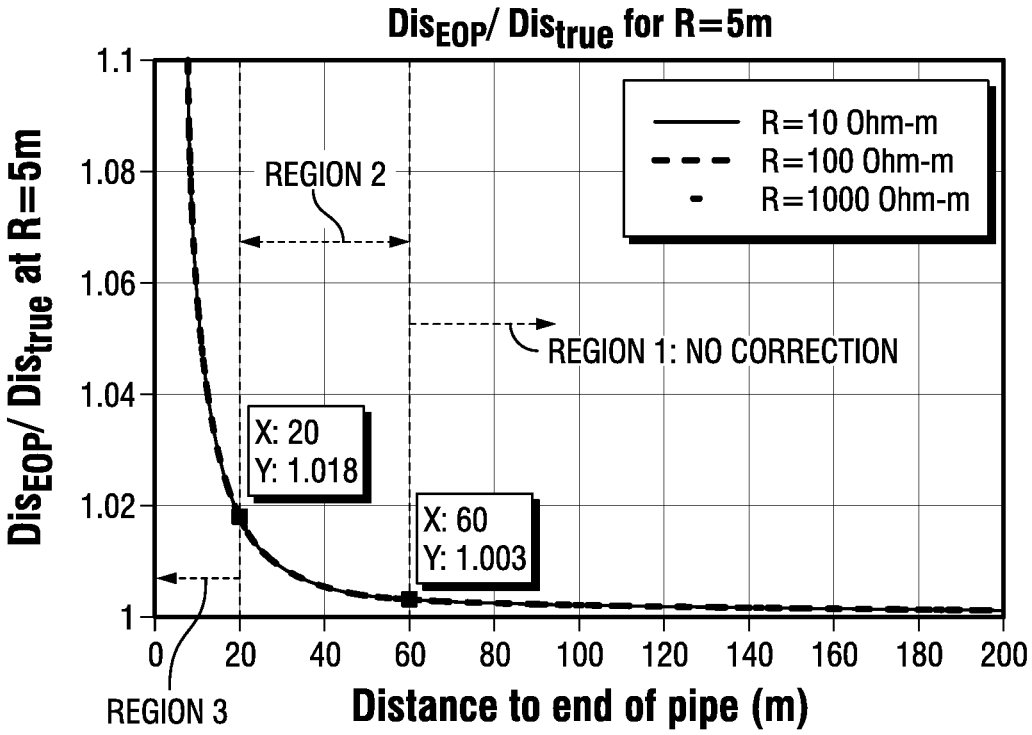
FIG. 5 is a graph of error in along different regions.

Based on the curve shown in FIG. 5, a combination correction method is disclosed to correct end-of-pipe effect in different regions along the measured depth as shown in the enlarged scale plot in FIG. 5. Assuming a 5% error requirement for ranging distance, calculation are shown below:

$$\frac{Dis_{EOP} - Dis_{true}}{Dis_{true}} \leq 5\% \tag{10}$$

with the correction ratio being:

$$\frac{Dis_{EOP}}{Dis_{true}} \leq 1.05 \tag{11}$$

To leave enough error margin for the low signal level downhole and background noise, DTE=60 m is chosen as the $L_{max}$ as the limit between region 1 and region 2 (As illustrated in FIG. 1).

Figure 6:
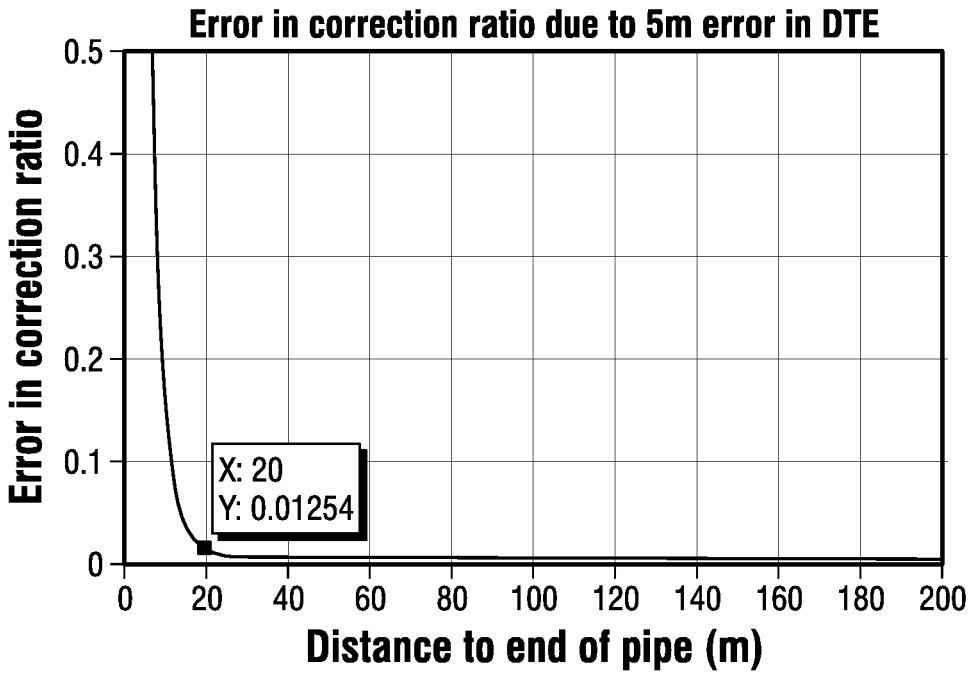
FIG. 6 is a graph of error along the distance to the end-of-pipe.

When DTE is close to 0, the correction ratio may increases. The correction ratio may be sensitive to the DTE. The correction ratio may be compared to a threshold. While the threshold may be set by an operator, the threshold may be five percent. Above five percent and methods, discussed below regarding region 3, may be utilized to correct DTE. A different correction method which is not sensitive to DTE may be used in region 3 (As illustrated in FIG. 1). Assuming the ranging survey interval is 10 m, there may be ±5 m error in DTE. FIG. 6 illustrates the error in the correction ratio caused by a 5 m DTE error. $Dis_{EOP}$ corrected by the correction error (including DTE error) may have less than 5% error compared to the $Dis_{true}$:

$$Dis_{EOP}/\text{Correction ratio at } (DTE=L_{min})\cdot(1+\text{Error in correction ratio at } (DTE=L_{min}))\leq 1.05\cdot Dis_{true} \tag{12}$$

Thus, $$1+\text{Error in correction ratio at } (DTE=20\text{ m})\leq 1.05 \text{ and Error in correction ratio at } (DTE=20\text{ m})\leq 0.05 \tag{13}$$

To leave enough error margin for the noise, DTE=20 m is chosen as the $L_{max}$ as the limit between region 2 and region 3. In region 2, the correction ratio may change slower than in Region 3, as seen from FIG. 5 and the error caused by the DTE error may be small, as illustrated in FIG. 6. Therefore, a look-up table approach based on DTE determination may be employed for end-of-pipe distance correction.

Since a one-to-one mapping table between DTE and $$\frac{Dis_{EOP}}{Dis_{true}}$$

may be obtained from simulation, it may be used to correct $Dis_{EOP}$. Once the distance from sensor 122 (Referring to FIG. 1) to end of target wellbore 102 is determined, the ratio $$\frac{Dis_{EOP}}{Dis_{true}}$$

may be found from the look-up table and the true distance $Dis_{true}$ may be determined. To determine DTE, a method utilizing triaxial measurements (Φ and Z-components of H-field) may be employed. Sensor 122 may measure three orthogonal field components to acquire a total field measurement. The three orthogonal field components may be: the normal component n, the tangential component t, and the z component, illustrated in FIG. 7. The normal component and the tangential component are in the same plane as the tool azimuthal plane. They are the H-field components (non-axial magnetic field measurements) used for ranging distance calculation such as $H_1$ and $H_2$ in FIG. 2. Non-axial magnetic field measurements may be processed by any suitable means, as discussed below, an referred to as Φ component $H_\Phi$ (processed non-axial magnetic field measurement). The z component direction is parallel to electromagnetic ranging tool 120, and is referred to as $H_z$ (axial magnetic field measurement).

Current leakage distribution along target well 102 may fluctuate depending on the direction in which the current may be flowing. For example, current in the Z-direction may be stronger (less leakage) than current in the X-direction (more leakage). Contrastingly, current at the end of target well 102 may dissipate uniformly in all directions. For example, dissipation of current in the Z-direction may be similar to dissipation of current in the X-direction. This may be due to EOP effect, current may leak uniformly in all directions instead of flowing along the Z axis. Thus, current in the X-direction and current in the Z-direction may increase the ratio with these variables. Therefore, the generated $H_z$ to $H_\Phi$ ratio will increase.

Figure 7:
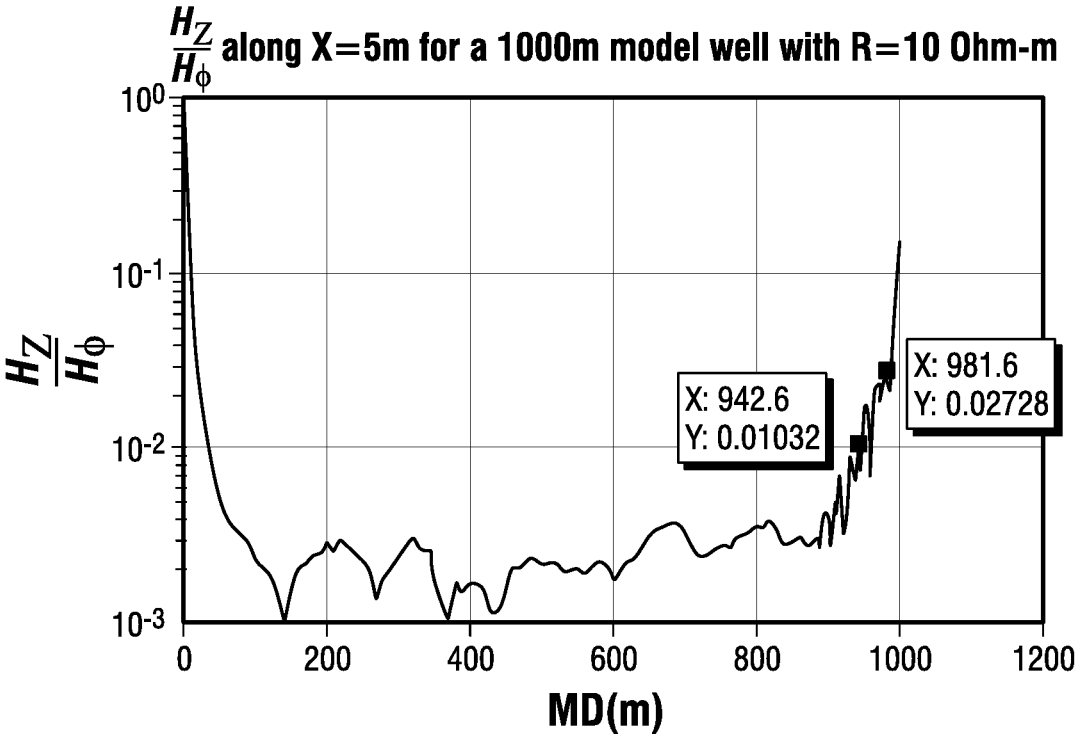
FIG. 7 is a graph of error correction.

FIG. 7 illustrates a simulated $$\frac{H_z}{H_\phi}$$

curve along a 1000 meteres conductive member 110. At 5 meters away from casing (X=5 m), it is illustrated that the $$\frac{H_z}{H_\phi}$$

ratio increases for the last 100 meters. Which may be consistent with the EOP Effect in region 3 (as illustrated in FIG. 1). Therefore, region 3 may be detected with the $$\frac{H_z}{H_\phi}$$

ratio. Referring to FIG. 2, region 2 may start with a DTE at 60 meters. Thus, once $$\frac{H_z}{H_\phi} > 0.01,$$

region 3 may begin. Once the DTE is determined, the $$\frac{Dis_{EOP}}{R}$$

ratio may be look-up from FIG. 6 and ranging distance may be corrected from $Dis_{EOP}$ to Dis_true.

In region 3, the correction ratio may change, as illustrated in FIG. 5, and the DTE error may be large, as seen from FIG. 6. Thus, the look-up table approach, as used in FIG. 2, based on DTE may not be used. Instead, a bad-point-correction method may be utilized for region 3.

An increase in distance error near the end of target wellbore 102 may be found through changes in H-field, Gradient H-field, and tilted angle. Thus, these three measurements may define the bad-point criteria as following:

(1). H-field dropping rate>0.3 && GH-field dropping rate>0.5. (EOP)

(2). (H-field dropping rate>0.3||GH-field dropping rate>0.5) & Tilted angle>10. (EOP)

(3). Tilted angle>15. (EOP)

The definition of dropping rate is:

$$H \text{ field dropping rate} = \frac{20*\log10(B(i-1)) - 20*\log10(B(i))}{MD(i) - MD(i-1)} \quad (14)$$

$$GH \text{ field dropping rate} = \frac{20*\log10(GB(i-1)) - 20*\log10(GB(i))}{MD(i) - MD(i-1)} \quad (15)$$

The definition of GH is:

$$GH=(H_{\phi 1}-H_{\phi 2})/\Delta S \quad (16)$$

The definition of Titled angle is:

$$\text{Tiltedangle}=a\tan 2d(\text{Hz},\sqrt{(H_n^2+H_t^2)}) \quad (17)$$

Figure 8:
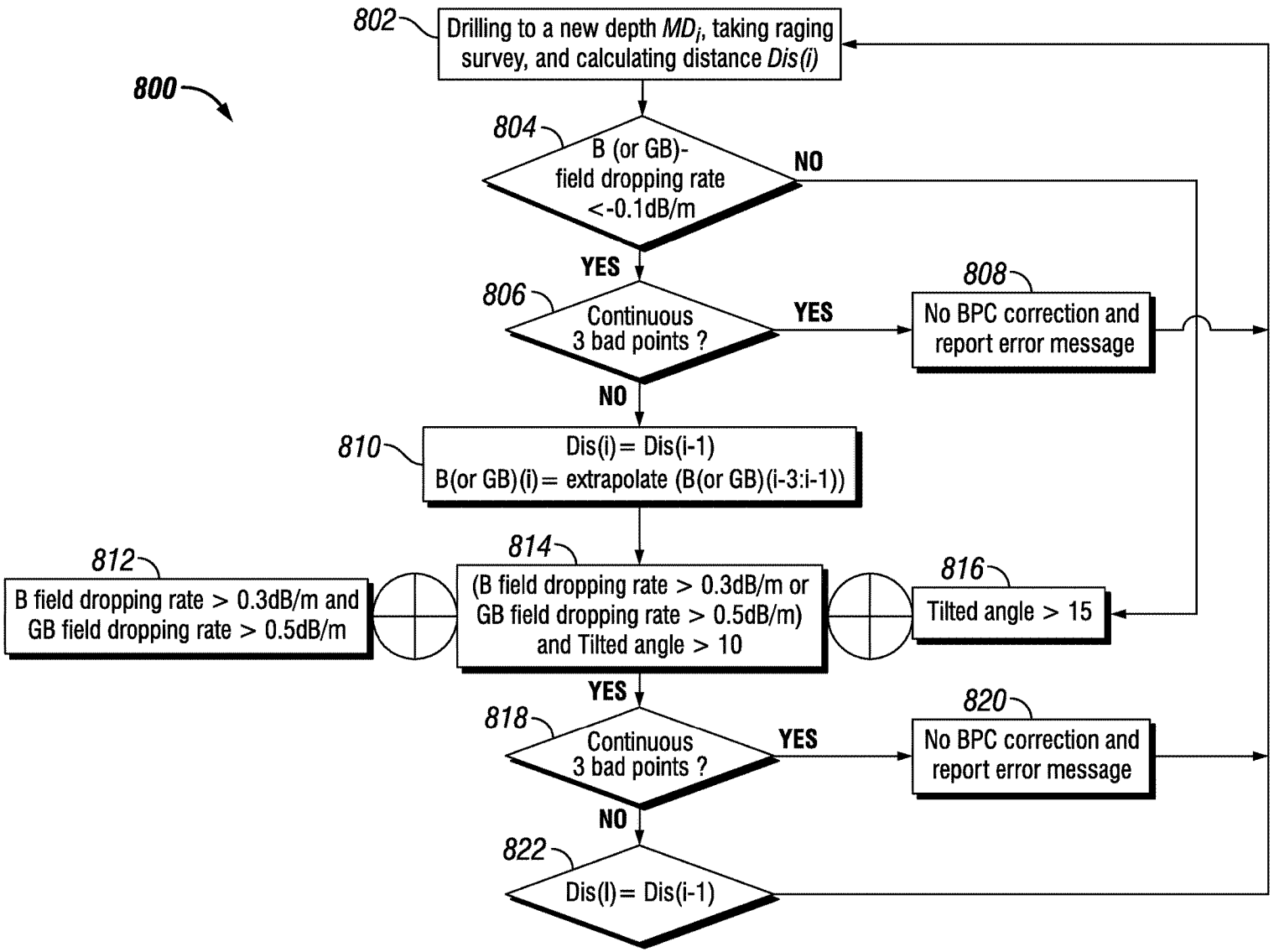
FIG. 8 is a flow chart for a bad-point correction method.

FIG. 8 illustrates bad-point correction (BPC) method 800. Bad-point correction method 800 may begin, as represented by box 802, by initializing the consecutive bad points number to 0. BPC may then move to the second survey onwards as shown in box 804. The starting sensor position for BPC method 800 may be referred to as a first location. When drilling to a new depth (a second location) with electromagnetic ranging tool 120 (Referring to FIG. 1), the ranging sensor records an electromagnetic field emanating from target wellbore 102 at a second location. The electromagnetic field at the second location may be analyzed, in box 808, 810 and 812, by information handling system 124 (Referring to FIG. 1). For example, the bad-point criteria may be as following:

(1). H-field dropping rate>0.3 && GH-field dropping rate>0.5. (EOP)

(2). (H-field dropping rate>0.3||GH-field dropping rate>0.5) & Tilted angle>10. (EOP)

(3). Tilted angle>15. (EOP)

If any of the conditions in box 806, 808, or 810 are satisfied it may be considered a bad point. Consecutive bad points at different sensor positions may increase the number of bad points in box 812. If there are three bad points or more than three consecutive bad points in box 814, then there is no BPC applied and an error is reported, as represented by box 816. If there are less than three consecutive bad points in box 814, then bad point correction (BPC) may be applied for this point. As shown in box 818, the distance and direction results at the second location may be replaced by the results at the first location based on the continuity of the survey. The drilling may then continue to the next location.

If none of the conditions in box 806, 808, or 810 are satisfied, it is determined as a good point. The consecutive bad point number is reset to 0 as shown in box 820 and drilling will continue to the next location.

Figure 9:
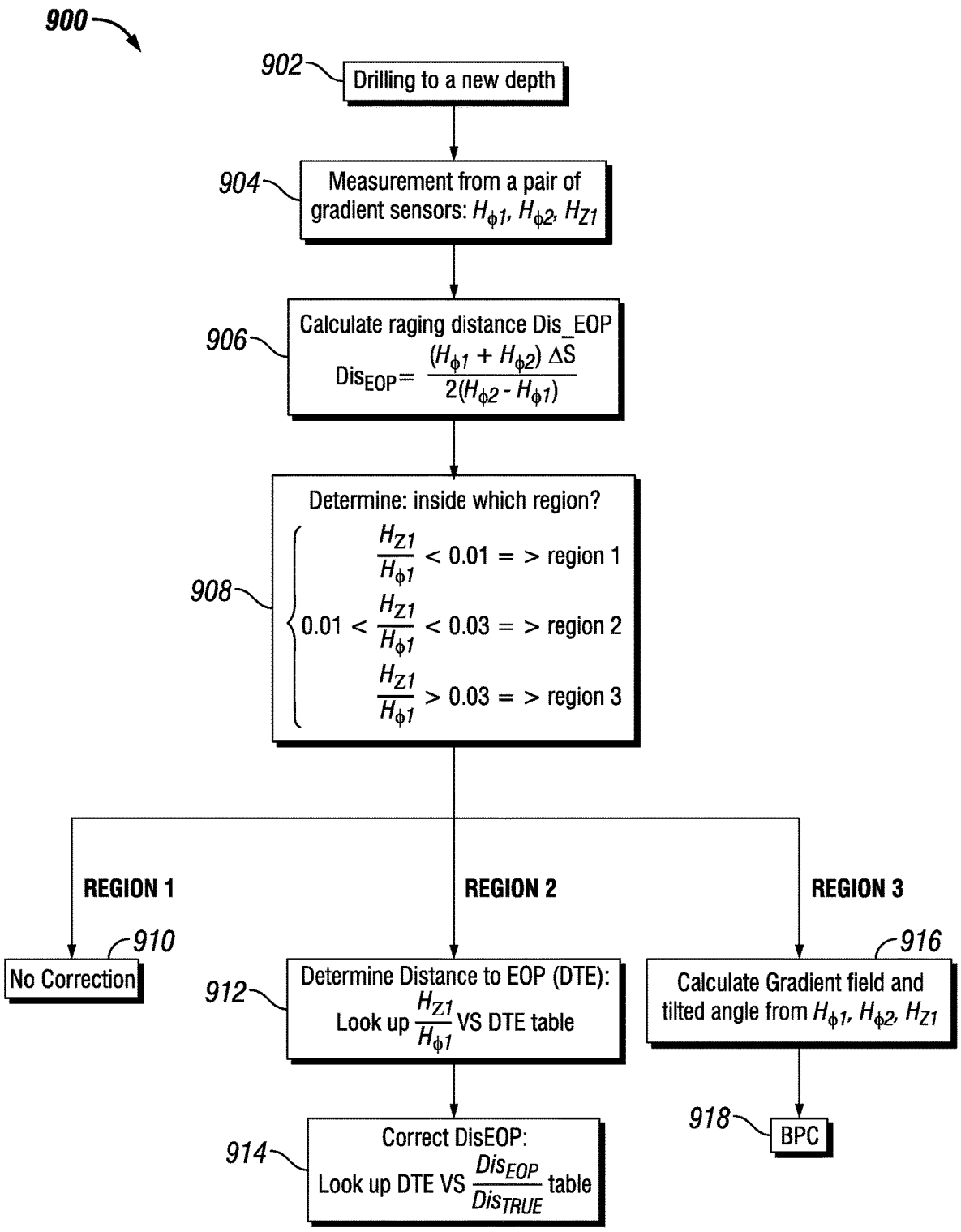
FIG. 9 is a flow chart for a region determination method.

FIG. 9 illustrates a region determination method 900. Region determination method 900 may begin, as represented by box 802, by drilling to a new depth electromagnetic ranging tool 120 (Referring to FIG. 1) and recording an electromagnetic field emanating from target wellbore 102 at a first location. In box 904, measurements may be taken from sensor 122 (Referring to FIG. 1), which may comprise a first component 200 and a second component 202 (Referring to FIG. 2). In box 906, the ranging distance may be calculated using Equations (1)-(9). In box 908, the $$\frac{H_z}{H_\phi}$$

ratio, may be utilized to determine what region electromagnetic ranging tool 120 may be located. If in region 1, box 910 indicates no correction to data may be required. If in region 2, box 912 may utilize $$\frac{H_z}{H_\phi}$$

ratio to look up for distance to the end of pipe (DTE) from FIG. 7. After that, box 914 can use DTE to look up for $$\frac{Dis_{EOP}}{Dis_{true}}$$

correction ratio from FIG. 5. Dividing the ranging distance in box 906 by this $$\frac{Dis_{EOP}}{Dis_{true}}$$

ratio, the corrected ranging distance may be obtained. If in region 3, box 916 may calculate the gradient field and tilt angle. After which BPC procedures, described above an in FIG. 8, in box 918 may be applied. The gradient field and tilted angle in box 916 may be used in box 812, 814, and 816 to determine bad points. Once a bad point is determined, the ranging results at the current location may be replaced by the ranging results at the previous location based on the continuity of the survey.

This method and system may include any of the various features of the compositions, methods, and system disclosed herein, including one or more of the following statements.

Statement 1: A method for electromagnetic ranging of a target wellbore, comprising: disposing an electromagnetic ranging tool in a wellbore; energizing a conductive member disposed in the target wellbore to create an electromagnetic field; measuring at least one component of the electromagnetic field from the target wellbore, wherein the measuring comprises performing at least two non-axial magnetic field measurements and performing at least one axial magnetic field measurement; calculating a processed non-axial magnetic field measurement using the at least two non-axial magnetic field measurements; calculating an end-of-pipe ratio with the processed non-axial magnetic field measurement and the at least one axial magnetic field measurement; and altering a course of the electromagnetic ranging tool based at least in part from the end-of-pipe ratio.

Statement 2: The method of statement 1, further comprising comparing a correction ratio to a threshold and selecting a correction method based on a result of the comparing the correction ratio to the threshold.

Statement 3: The method of statement 1 or statement 2, further comprising applying the correction method with the correction ratio to obtain an end-of-pipe correction result and estimating distance and direction to the target wellbore using the correction method.

Statement 4: The method of any previous statement, wherein the correction method is no correction.

Statement 5: The method of any previous statement, wherein the correction method is a look-up table or inversion based correction.

Statement 6: The method of any previous statement, wherein the correction ratio determines a distance to an end of the target wellbore.

Statement 7: The method of any previous statement, wherein the calculating the processed non-axial magnetic field measurement comprises calculating a direction to the target wellbore and estimating the non-axial magnetic field measurement in the direction of the target wellbore, wherein the non-axial magnetic field measurement in the direction of the target wellbore is tangentially oriented with respect to the target wellbore.

Statement 8: The method of any previous statement, wherein the correction ratio is between 0.01 and 0.03 indicates a region one.

Statement 9: The method of any previous statement, wherein no correction is performed in the region one.

Statement 10: The method of any previous statement, wherein the correction ratio between 0.03 and 0.1 indicates a region two.

Statement 11: The method of any previous statement, wherein a look-up table or an inversion based correction is performed in the region two.

Statement 12: The method of any previous statement, wherein if the correction ratio is greater than the threshold indicate a third region, wherein an interpolation based correction is performed.

Statement 13: A well ranging system for location a target wellbore comprising: a downhole assembly, wherein the downhole assembly comprises: a sensor comprising a first component and a second component; and a drill string, wherein the downhole assembly is attached to the drill string; and an information handling system, wherein the information handling system is operable to measure at least one component of an electromagnetic field from the target wellbore; perform at least two non-axial magnetic field measurements; perform at least one axial magnetic field measurement; calculate a processed non-axial magnetic field measurement using the at least two non-axial magnetic field measurements; calculate an end-of-pipe ratio with the processed non-axial magnetic field measurement and the at least one axial magnetic field measurement; and alter course of the downhole assembly.

Statement 14: The well ranging system of statement 13, wherein the information handling system is operable to compare a correction ratio to a threshold, select a correction method, apply the correction method, estimate distance, and direction to the target wellbore.

Statement 15: The well ranging system of statement 13 and statement 14, wherein the correction method is no correction.

Statement 16: The well ranging system of statement 13-15, wherein the correction method is a look-up table or inversion based correction.

Statement 17: The well ranging system of statement 13-16, wherein the correction method is an interpolation based correction.

Statement 18: The well ranging system of statement 13-17, wherein the information handling system is operable to calculate the processed non-axial magnetic field measurement comprises calculating a direction to the target wellbore and estimating a non-axial magnetic field measurement in the direction of the target wellbore, the processed non-axial magnetic field measurement.

Statement 19: The well ranging system of statement 13-18, wherein the non-axial magnetic field measurement in direction of the target wellbore is tangentially oriented with respect to the target wellbore.

Statement 20: The well ranging system of statement 13-19, wherein the compare the end-of-pipe ratio to the threshold is selected from at least three different end-of-pipe correction methods based on results of a first and second comparison.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for electromagnetic ranging of a target wellbore, comprising:

disposing an electromagnetic ranging tool in a wellbore;

energizing a conductive member disposed in the target wellbore to create an electromagnetic field;

measuring at least one component of the electromagnetic field from the target wellbore, wherein the measuring comprises performing at least two non-axial total electromagnetic field measurements and performing at least one axial electromagnetic field measurement;

calculating a processed non-axial electromagnetic field measurement using the at least two non-axial total electromagnetic field measurements;

calculating a correction ratio for an end-of-pipe effect with the processed non-axial electromagnetic field measurement and the at least one axial electromagnetic field measurement; and altering a course of the electromagnetic ranging tool based at least in part from the correction ratio.

2. The method of claim 1, further comprising comparing the correction ratio to a threshold and selecting a correction method based on a result of the comparing the correction ratio to the threshold.

3. The method of claim 2, further comprising applying the correction method with the correction ratio to obtain a correction result and estimating distance and direction to the target wellbore using the correction method.

4. The method of claim 2, wherein the correction method is no correction.

5. The method of claim 2, wherein the correction method is a look-up table or inversion based correction.

6. The method of claim 2, wherein the correction ratio determines a distance to an end of the target wellbore.

7. The method of claim 2, wherein the correction method is an interpolation based correction.

8. The method of claim 1, wherein the calculating the processed non-axial electromagnetic field measurement comprises calculating a direction to the target wellbore and estimating the non-axial electromagnetic field measurement in the direction of the target wellbore, wherein the non-axial electromagnetic field measurement in the direction of the target wellbore is tangentially oriented with respect to the target wellbore.

9. A well ranging system for location a target wellbore comprising:

a downhole assembly, wherein the downhole assembly comprises:

a sensor comprising a first component and a second component; and a drill string, wherein the downhole assembly is attached to the drill string; and an information handling system, wherein the information handling system is operable to measure at least one component of an electromagnetic field from the target wellbore;

perform at least two non-axial total electromagnetic field measurements; perform at least one axial electromagnetic field measurement; calculate a processed non-axial electromagnetic field measurement using the at least two non-axial electromagnetic field measurements; calculate a correction ratio for an end-of-pipe effect with the processed non-axial electromagnetic field measurement and the at least one axial electromagnetic field measurement; and alter course of the downhole assembly.

10. The well ranging system of claim 9, wherein the information handling system is operable to compare the correction ratio to a first threshold, select a correction method, apply the correction method, estimate distance, and direction to the target wellbore.

11. The well ranging system of claim 10, wherein the correction method is no correction.

12. The well ranging system of claim 10 wherein the correction method is a look-up table or inversion based correction.

13. The well ranging system of claim 10, wherein the correction method is an interpolation based correction.

14. The well ranging system of claim 10, wherein the correction method is selected from the compare the correction ratio to a first threshold and a second threshold.

15. The system of claim 14, wherein the first threshold is between 0.01 and 0.03.

16. The method of claim 14, wherein the second threshold is between 0.03 and 0.1.

17. The method of claim 14, wherein if the correction ratio smaller than the first threshold no correction is performed.

18. The method of claim 14, wherein if the correction ratio is between the first threshold and the second threshold a look-up table or an inversion based correction is performed.

19. The method of claim 14, wherein if the correction ratio is larger than a second threshold an interpolation based correction is performed.

20. The well ranging system of claim 9, wherein the information handling system is operable to calculate the processed non-axial electromagnetic field measurement comprises calculating a direction to the target wellbore and estimating a non-axial electromagnetic field measurement in the direction of the target wellbore, the processed non-axial electromagnetic field measurement.

21. The well ranging system of claim 9, wherein the non-axial electromagnetic field measurement in direction of the target wellbore is tangentially oriented with respect to the target wellbore.

* * * * *